US007449662B2

(12) United States Patent
Elgee et al.

(10) Patent No.: US 7,449,662 B2
(45) Date of Patent: Nov. 11, 2008

(54) AIR HEATING APPARATUS

(75) Inventors: Steven B. Elgee, Portland, OR (US); Parveen Sidhu, Vancouver, WA (US); Robert M. Yraceburu, Camas, WA (US); Stephen McNally, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 642 days.

(21) Appl. No.: 10/832,089

(22) Filed: Apr. 26, 2004

(65) Prior Publication Data

US 2005/0237370 A1 Oct. 27, 2005

(51) Int. Cl.
*H05B 1/02* (2006.01)

(52) U.S. Cl. ..... 219/494; 219/216; 219/497; 399/69

(58) Field of Classification Search ..... 219/216, 219/494, 497, 499, 501, 506, 508, 483–486, 219/505; 399/67–70; 307/117, 38–41
See application file for complete search history.

(56) References Cited

U.S. PATENT DOCUMENTS

| | | | | |
|---|---|---|---|---|
| 4,645,908 | A * | 2/1987 | Jones | 392/340 |
| 5,212,498 | A | 5/1993 | Sugimori | |
| 5,390,011 | A * | 2/1995 | Theodoulou | 399/307 |
| 5,422,662 | A | 6/1995 | Fukushima et al. | |
| 5,682,185 | A | 10/1997 | Wade et al. | |
| 5,730,438 | A | 3/1998 | Webb et al. | |
| 5,781,205 | A | 7/1998 | Silverbrook | |
| 5,841,449 | A | 11/1998 | Silverbrook | |
| 5,844,581 | A | 12/1998 | DeJoseph et al. | |
| 6,072,163 | A * | 6/2000 | Armstrong et al. | 219/497 |
| 6,199,969 | B1 | 3/2001 | Haflinger et al. | |
| 6,244,700 | B1 | 6/2001 | Kimura et al. | |
| 6,302,507 | B1 | 10/2001 | Prakash et al. | |
| 6,315,381 | B1 | 11/2001 | Wade et al. | |
| 6,334,660 | B1 | 1/2002 | Holstun et al. | |
| 6,386,674 | B1 | 5/2002 | Corrigan, III et al. | |
| 6,409,298 | B1 | 6/2002 | Ahne et al. | |
| 6,428,160 | B2 | 8/2002 | Roy et al. | |
| 6,565,176 | B2 | 5/2003 | Anderson et al. | |
| 6,688,719 | B2 | 2/2004 | Silverbrook et al. | |
| 2001/0019279 | A1 | 9/2001 | Martin et al. | |
| 2003/0193538 | A1 | 10/2003 | Silverbrook et al. | |

FOREIGN PATENT DOCUMENTS

| | | |
|---|---|---|
| EP | 0260629 | 9/1987 |
| GB | 2355518 | 4/2001 |
| JP | 08308101 | 11/1996 |

OTHER PUBLICATIONS

British Search Report dated Aug. 12, 2005.

* cited by examiner

*Primary Examiner*—Mark H Paschall

(57) ABSTRACT

An embodiment of an air heating apparatus includes a mass to store heat energy and a heater to provide the heat energy to the mass.

53 Claims, 7 Drawing Sheets

AIR HEATING APPARATUS

BACKGROUND

Systems that make use of heating elements can sometimes draw, or attempt to draw, current from a power source that can approach or exceed over-current protection limits associated with the power source. This may result in operation of current protection mechanisms associated with the power source.

BRIEF DESCRIPTION OF THE DRAWINGS

The drawings referenced herein form a part of the specification. Features shown in the drawing are meant as illustrative of only some embodiments, and not of all embodiments.

Shown in FIG. 1 is an embodiment of an image forming system.

Figure 2:
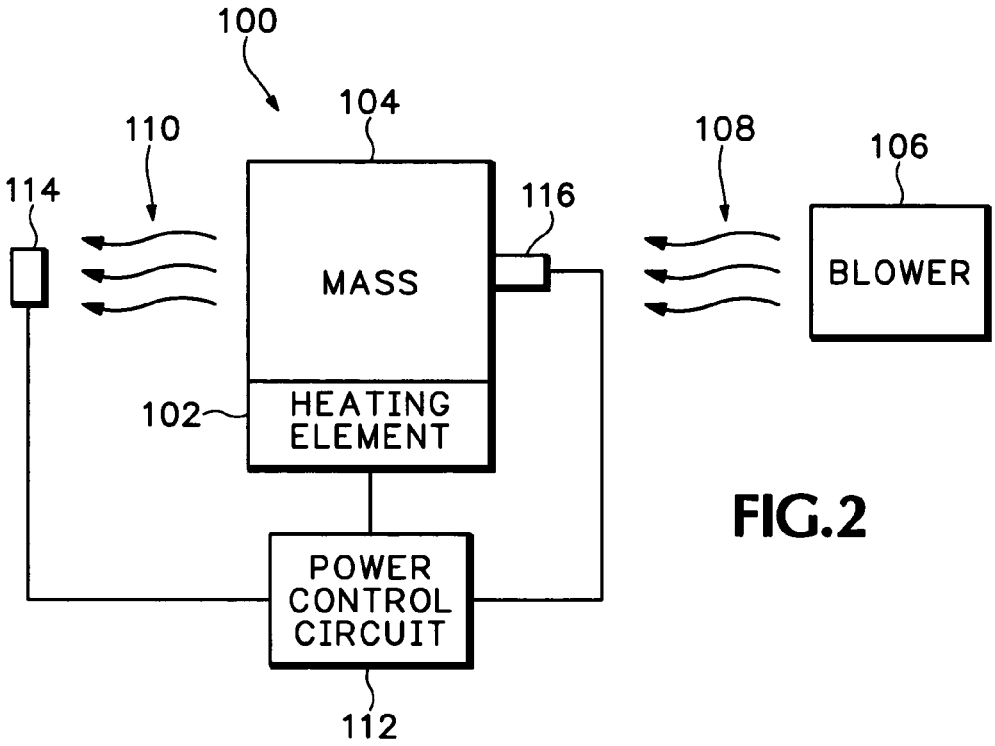

Shown in FIG. 2 is an embodiment of an air heating apparatus.

Figure 3A:
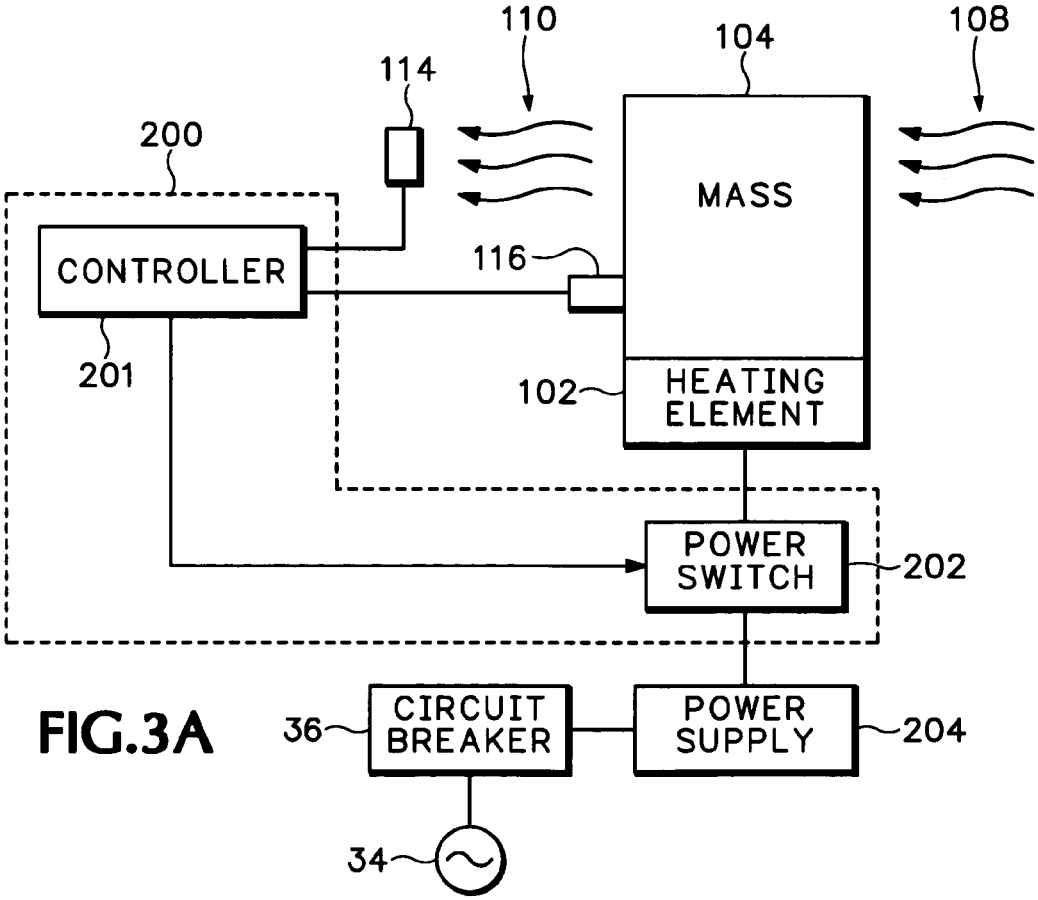
Figure 3B:
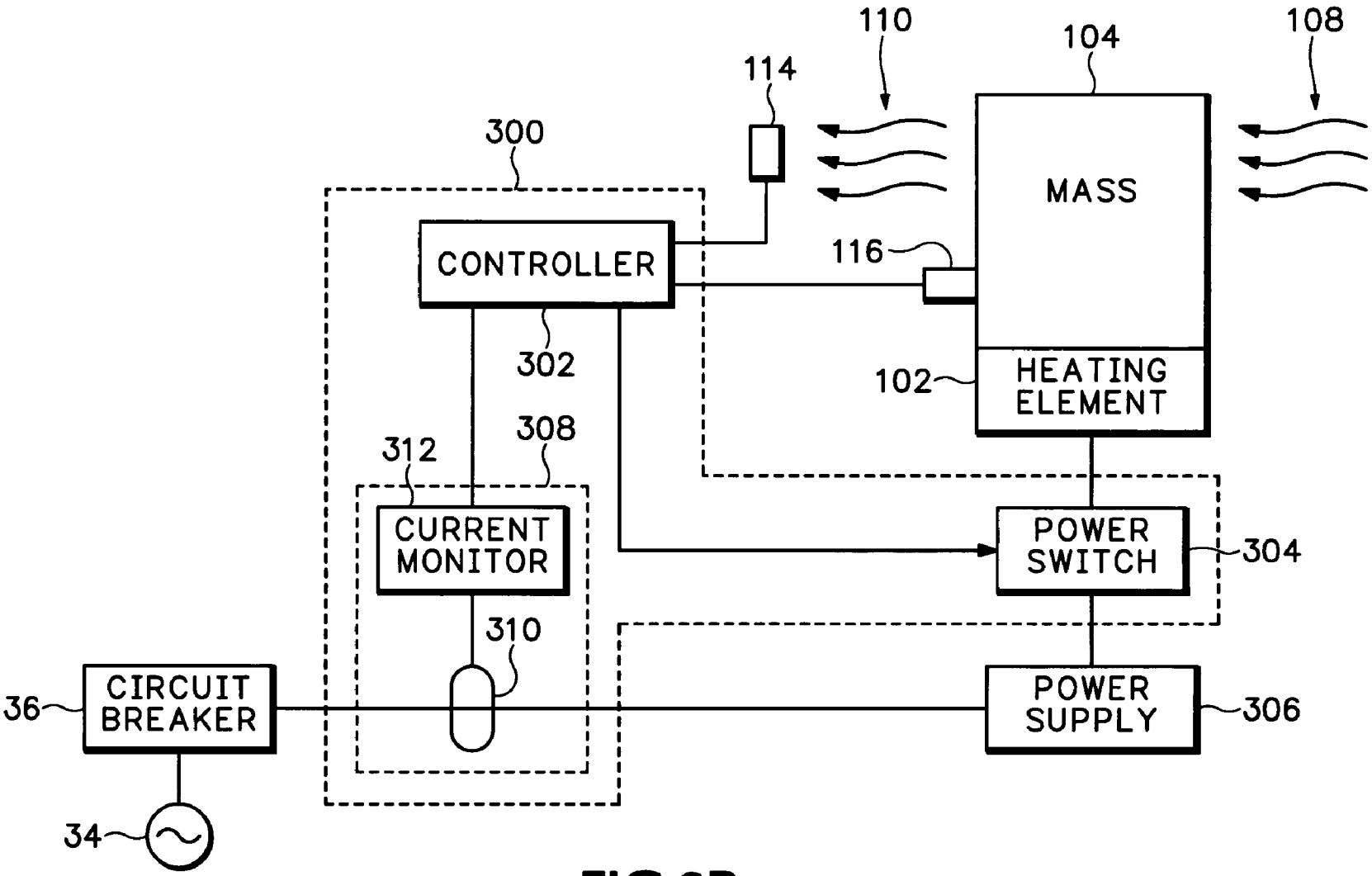

Shown in FIGS. 3A-3B are embodiments of power control circuits.

Shown in FIGS. 4A-4D are embodiments of enclosures that may be used with embodiments of an air heating apparatus.

Figure 5:
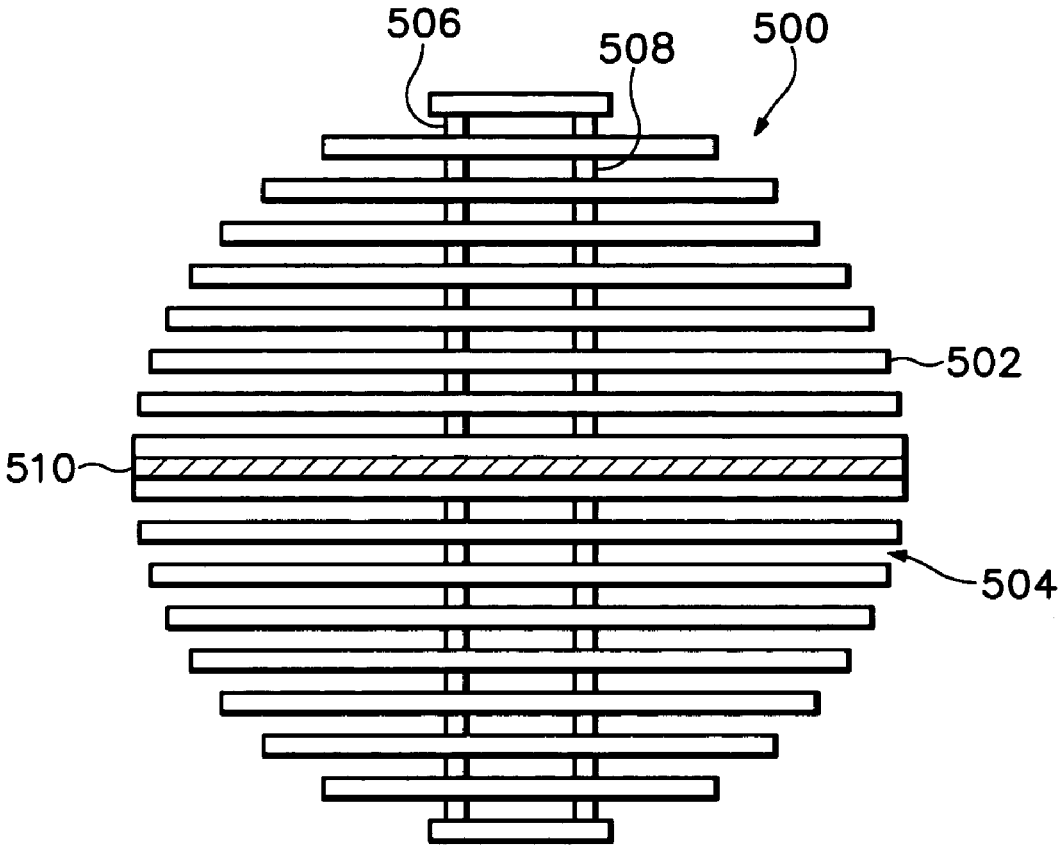

Shown in FIG. 5 is an embodiment of a mass that may be used in an embodiment of an air heating apparatus.

Figure 6:
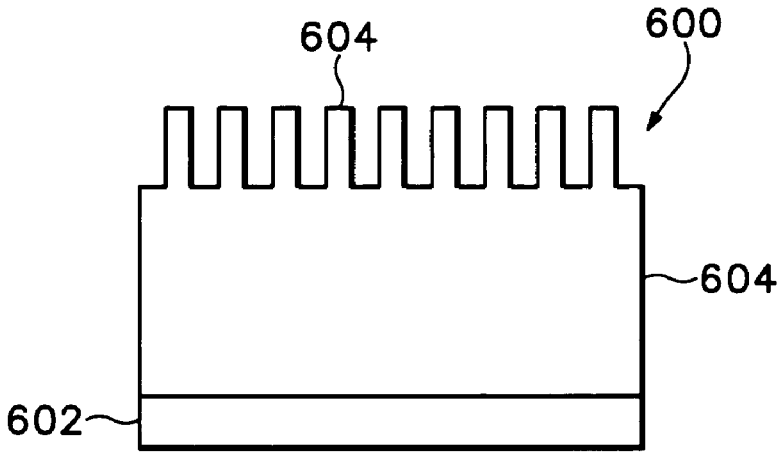

Shown in FIG. 6 is an embodiment of a mass that may be used in an embodiment of an air heating apparatus.

Figure 7:
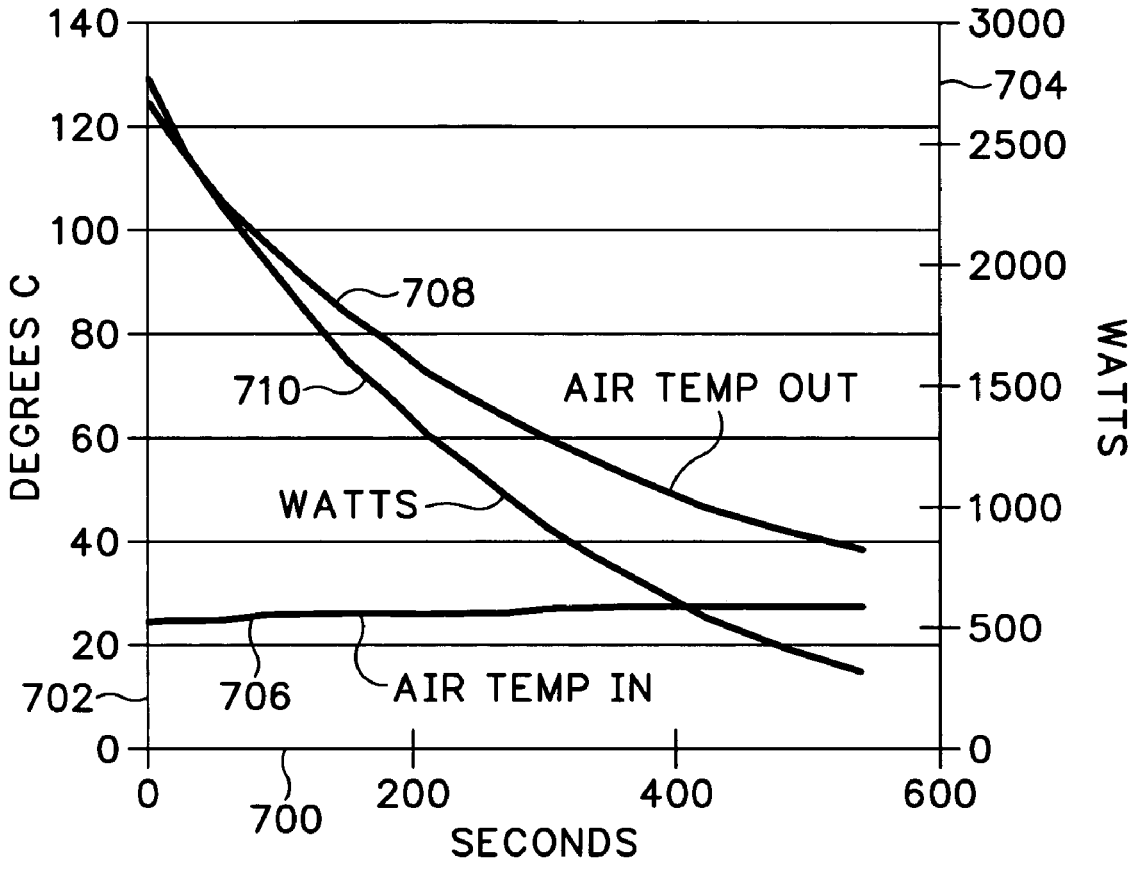

Shown in FIG. 7 is measurement data related to an embodiment of a mass.

DETAILED DESCRIPTION

Some systems, such as embodiments of image forming systems, include embodiments of heaters, such as heating elements, for heating air that is used for vaporizing fluid in colorant, such as ink, ejected onto media. Depending upon the image forming system, the heating elements can draw considerable current from the power source, such as an AC power main circuit (referred to as an AC power main), supplying the image forming system. During an image forming operation, the image forming system will likely draw current from the AC power main, in addition to the current used to power the heating element, to power other assemblies in the image forming system.

AC power mains may be equipped with over-current protection. The over-current protection may include circuit breakers or fuses. Depending upon the over-current protection limit for a particular AC power main to which the image forming system is connected and the current used by the image forming system, it is possible that the over-current protection may be actuated during the normal operation of the image forming system.

Figure 1:
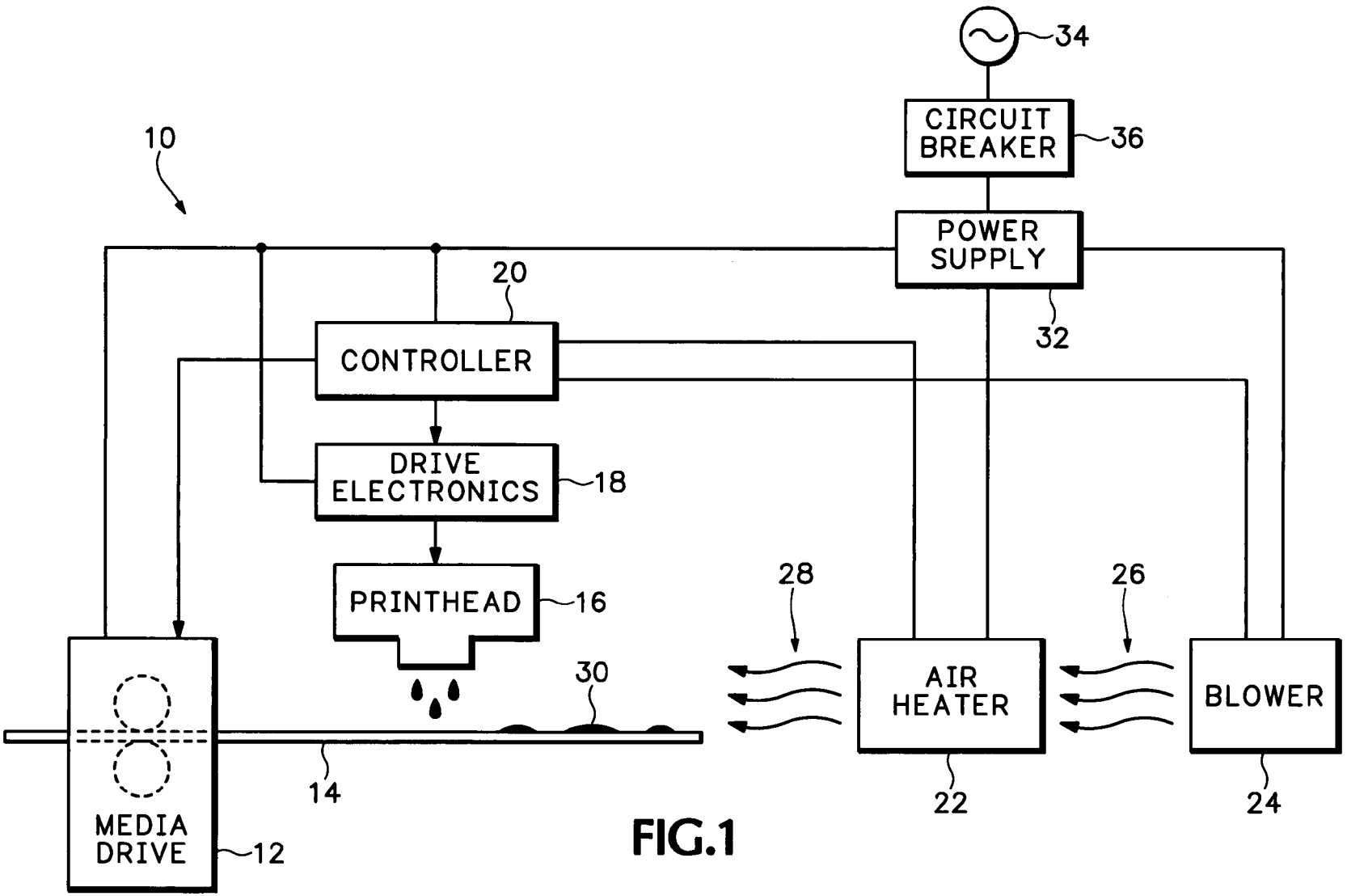

Shown in FIG. 1 is one embodiment of an image forming system, ink jet printing system 10 shown in a simplified form for ease of illustration. Ink jet printing system 10 includes an embodiment of a media movement mechanism, media drive 12, to move media, such as a unit of media 14, from a media storage bin (not shown in FIG. 1) past an embodiment of a colorant ejection device, such as printhead 16 during an image forming operation. Printhead 16 represents, as may be used in various embodiments of ink jet printing system 10, an array of one or more printheads. For ease of illustration, media drive 12 is shown as present at one location in the media path. However, in other embodiments, structure associated with media drive 12 may be located at various places within ink jet printing system 10 to perform the function of moving media within ink jet printing system 10. As media 14 moves past printhead 16, colorant, such as ink, is ejected onto media 14 to form an image corresponding to image data received by ink jet printing system 10. Signals provided to printhead 16 cause ejection of the ink from printhead 16 to form the image. Drive electronics 18 generate the signals to cause printhead 16 to eject the ink to form the image. An embodiment of a processing device, such as controller 20, provides data, formed using the image data, to drive electronics 18 to generate the signals provided to printhead 16. In various embodiments, controller 20 may include a microprocessor executing firmware or software instructions to accomplish its tasks. Or, controller 20 may be included in an application specific integrated circuit (ASIC), formed of hardware and controlled by firmware specifically designed for the tasks it is to accomplish.

The software or firmware may be stored on an embodiment of a computer-readable media included with or separate from controller 20. A computer readable medium can be any media that can contain, store, or maintain programs and data for use by or in connection with the execution of instructions by a processing device. Computer readable media can comprise any one of many physical media such as, for example, electronic, magnetic, optical, electromagnetic, infrared, semiconductor media, or any other suitable media. More specific examples of suitable computer-readable media include, but are not limited to, a portable magnetic computer diskette such as floppy diskettes or hard drives, a random access memory (RAM), a read-only memory (ROM), an erasable programmable read-only memory, or a portable compact disc. Computer readable media may also refer to signals that are used to propagate the computer executable instructions over a network or a network system such as the Internet.

Controller 20 may include a configuration to provide signals to media drive 12 to influence the movement of media through ink jet printing system 10 for accomplishing the image formation operation. Furthermore, controller 20 includes a configuration to provide one or more signals that influence the operation of an embodiment of an air heating apparatus, such as air heater 22. Air heater 22 may include an embodiment of a heater, such as a heating element, that contributes to the heating of air near air heater 22. An embodiment of an air movement device or mechanism, such as blower 24, pushes air 26 toward air heater 22 so that heat may be transferred from air heater 22 to air 26. As air 26 moves past air heater 22 on its way toward media 14, heat is transferred to air 26. The heated air 28 continues to move from air heater 22 toward media 14. Heated air 28 passing over media 14 provides energy to vaporize at least part of the fluid included in ink 30 deposited onto media 14. In one embodiment, air including the vaporized fluid is discharged from ink jet printing system 10.

Power is supplied to air heater 22 by an embodiment of a power supply, power supply 32. In one embodiment, power supply 32 may supply a DC voltage used to power the heating element included within air heater 22. In other embodiments of power supply 32, an AC voltage may be supplied to power the heating included within air heater 22. Power supply 32 also supplies power to other assemblies included in ink jet printing system 10 and shown in FIG. 1, such as for example controller 20 and media drive 12, and assemblies not shown in FIG. 1 for ease of illustration. Each of the assemblies to which power is supplied by power supply 32 contributes to the current drawn by power supply 32 from an embodiment of a power source, such as AC power main 34. Additionally, in various embodiments of ink jet printing system 10, other assemblies within ink jet printing system 10 may draw current from AC power main 34 in ways other than through power supply 32, such as directly from AC power main 34 or through other power supplies included within ink jet printing system 10.

As mentioned previously, AC power main 34 can include an embodiment of an over-current protection device, such as circuit breaker 36. Circuit breaker 36 could include, for example, a magnetic, thermal (such as with a bimetallic strip), thermal magnetic, electronically switched circuit breaker, or other suitable over-current protection device. In alternate embodiments the over-current protection device could include a fuse. To reduce the likelihood that the current supplied by AC power main 34 to ink jet printing system 10 is interrupted, one embodiment of air heater 22 operates to limit a magnitude of the current supplied to ink jet printing system 10 to less than a current that would result in actuation of circuit breaker 36. In one embodiment of air heater 22, the current supplied to a heating element included in air heater 22 is controlled to limit a magnitude of current drawn from AC power main 34, resulting from all the loads connected to it (which may include loads other than ink jet printing system 10), to less than the current rating of AC power main 34. The current rating of AC power main 34 may be regarded in some embodiments of AC power main 34 as the highest level of current that AC power main 34 is specified to carry, with the over current protection device associated with AC power main 34 selected to actuate at a current above the specified highest level of current for AC power main 34 to reduce the occurrence of actuation from transient currents. In other embodiments of AC power main 34, its current rating may be regarded as the level of current at which actuation of the over-current protection device is designed to occur. Many types of commercial installations have AC power main circuits with a 20 amp current rating. Many residential installations have AC power main circuits with a 15 amp current rating. Embodiments of air heater 22 could provide performance benefits with these types of installations or on installations having different current ratings.

In one embodiment of air heater 22, the heating element included in air heater 22 is capable of operating at a level of output power such that a magnitude of the current that would be supplied to ink jet printing system 10 by AC power 34 during an image forming operation would exceed the current rating of AC power main 34, if circuit breaker 36 was not present to limit the current. But, controller 20 controls the operation of the heating element during the image forming operation to maintain the magnitude of the current below the current rating of AC power main 34. In another embodiment of air heater 22, the current supplied to a heating element included in air heater 22 is controlled so that power is not supplied to the heating element during an image forming operation when fluid is vaporized from a colorant deposited on units of media 14.

Shown in FIG. 2 is an embodiment of an air heating apparatus, such as air heater 100. In one embodiment, air heater 100 includes heating element 102 and an embodiment of a mass, mass 104. Heating element 102 provides heat energy that is stored in the material included in mass 104. Mass 104 serves as a structure to store heat energy for use in vaporizing fluid included in a colorant, such as ink, ejected onto media 14. Blower 106 moves air 108 past mass 104. As air 108 moves past mass 104, heat may be transferred from mass 104 to air 108. Where a temperature of mass 104 is greater than a temperature of air 108, a temperature of air 110 will be greater than the temperature of air 108. An embodiment of a power control circuit, power control circuit 112 controls the application of power to heating element 102 using at least one of air temperature sensor 114 and mass temperature sensor 116. In one embodiment of power control circuit 112, the signal provided by mass temperature sensor 116 could be used in determining whether power should be applied to heating element 102. And, the signal provided by air temperature sensor 114 could be monitored to provide an indication of the effectiveness of heat transfer from mass 104 to air 110. Some embodiments of power control circuit 112 may not make use of a sensor to monitor air temperature. Any suitable type of temperature sensor may be used for temperature sensor 114 or temperature sensor 116. For example some embodiments of temperature sensor 114 and 116 could make use of thermistors suitable for the range of temperatures experienced by air 110 or mass 104. Other embodiments of temperature sensor 114 and 116 could make use of bimetallic strip type of thermometer.

By storing heat energy in mass 104 air 108 can be heated for use in removing fluid from ink, after ejection of the ink upon media 14, without applying power to heating element 102, or applying reduced power, during a process of forming an image upon media 14, thereby allowing ink jet printing system 10 to maintain its current draw at a value that is less than the current rating of AC power main 34. The amount of heat energy stored in mass 104 permits sufficient heat energy to be transferred to air 108 so that air 110 can beneficially vaporize fluid in ink while supplying substantially no power or reduced power to heating element 102. The volume of air that can be adequately heated to beneficially vaporize fluid, while supplying substantially no power or reduced power to heating element 102, is dependent upon the volume of material included in mass 104. Of course, the number of units of media 14 for which the fluid in the ejected ink can be vaporized will be related to this volume of air.

A unit of media 14 regarded as having a relatively high density of ink ejected onto it may have at least ¼ gram of fluid. A substantial portion of the fluid may comprise water. To substantially vaporize this fluid, approximately 600 Joules of energy are used. Some embodiments of inkjet printing system 10 are designed remove approximately 50% of the fluid included in the ink deposited during the image forming process. Such embodiments are regarded as having a 50% drying efficiency. Therefore a design value that could be used in selecting the volume of material included in mass 104 is about 600 Joules per high density page onto which ink has been ejected. Of course, other design values that are higher or lower may be appropriate depending upon such things as the amount of fluid ejected for a high density page and the energy used in vaporizing the fluid.

Another design value used in selecting the volume of material included in mass 104 is the number of units of media included in what is expected to be the largest print job. In one possible application of inkjet printing system 10, about 400 units of media is the expected largest print job. Of course, for other embodiments of inkjet printing system 10 used in other applications, the number of units of media expected for the largest print job may be higher or lower. For example, in some applications, 40 units of media may be the largest number expected in a single print job.

It may occasionally occur that the size of some print jobs exceeds what has been designated as the maximum expected size for the particular embodiment of inkjet printing system 10. For these types of print jobs, the energy available from mass 104 for the units of media 14 in excess of the maximum expected number for which mass 104 was selected may not be sufficient to achieve the desired level of vaporization. In some modes of operation, there is a trade off that can be made between the rate at which images could be formed on units of media 14 using ink jet printing system 10 and the magnitude of the current drawn by ink jet printing system 10 from AC power main 34. In these modes, the magnitude of the current drawn can be reduced by reducing the rate at which images are formed on units of media 14 because the amount of energy consumed per unit time by air heater 100 to accomplish the desired level of fluid vaporization will be reduced. In a print job, for those units of media 14 that exceed the number of units of media 14 expected in the largest print job, embodiments of air heater 100 could be configured to supply power to heating element sufficient to achieve the desired degree of fluid vaporization at such a level that maintains the current drawn by ink jet printing system 10 below a value that is less than the current rating of AC power main 34 while images are formed on these excess units of media 14 at a reduced rate.

One type of material that has been found to be suitable for use in mass 104 is aluminum. With the heat capacity of aluminum, a volume of approximately 1 liter can provide approximately 240 Kilojoules of heat energy with a change in temperature of approximately 100 degrees centigrade. This quantity of heat energy could be used to vaporize the fluid in ink for about 400 units of media, allocating about 600 Joules for each unit of media. The use of this volume of material would allow for a desired degree of vaporization of fluid in the ink deposited on about 400 units of media without applying power to heating element 102. It should be recognized that many other materials may be used for storing heat energy such as zinc, iron, or another suitable material. Additionally, materials that may undergo a phase change during the storage of energy may be used. Some examples of a phase change material include waxes, such as paraffin, and low temperature alloys, such as Metspec 281. Use of some types of phase change material may allow storage of an equal amount of heat energy in up to a 30%, or more, smaller volume of phase change material than would be used if a non-phase change material were used.

In an alternate embodiment of mass 104, it could be implemented with a volume of approximately 0.1 liter of aluminum. With this volume of material, approximately 24 Kilojoules of heat energy would be extracted with a change in temperature of approximately 100 degrees centigrade. This quantity of heat energy could be used to vaporize the fluid in ink for about 40 units of media, allocating 600 Joules for each unit of media. It should be recognized that a wide range of volumes of material to store heat energy may be used. The volume selected will be influenced by the number of units of media for which it is desired to have heat energy stored in mass 104 available for vaporizing the fluid on the units of media.

Shown in FIG. 3A is an embodiment of a power control circuit, power control circuit 200. The layout illustrated in FIG. 3A is for ease of illustration and not to indicate any particular spatial relationship between the illustrated elements. Controller 201 provides a signal to control the operation of an embodiment of a switch, power switch 202. Power switch 202 operates to selectively apply power supplied from power supply 204 to heating element 102. Power supply 204 may have a function and structure similar to power supply 32 shown in FIG. 1. Similar to power supply 32, power supply 204 may supply power to assemblies other than those shown in FIG. 3A. In various embodiments power supply 204 may supply DC voltages/currents, AC voltages/currents or a suitable combination of these. Power switch 202 may include any of a variety of suitable devices that can switch between a relatively low resistance state in which substantial power is supplied to heating element 102 and a relatively high resistance state in which substantially no power is supplied to heating element 102. Embodiments of power switch 202 may include, for example, an electromechanical relay, one of the possible types of thyristors, a configuration of one or more bi-polar transistors of appropriate current rating, or a configuration of one or more MOSFETs of appropriate current rating. Additionally power switch 202 may include components used with one of the previously mentioned switched devices to accomplish the switching function.

Controller 201 may include functionality in addition to functionality related to providing the signal to operate power switch 202. For example, controller 201 may include functionality to accomplish the tasks indicated for controller 20 shown in FIG. 1. Or, controller 201 may include functionality to accomplish fewer tasks than controller 20 or to accomplish tasks in addition to or different from those accomplished by controller 20. In one embodiment of controller 201 and power switch 202, controller 201 provides a pulse width modulated signal to a power MOSFET included in power switch 202 to control the power supplied to heating element 102. With controller 201 varying the duty cycle of the signal provided to power switch 202, the power supplied to heating element 102 can be varied.

In one embodiment of power control circuit 200, controller 201 operates to allow the application of power to heating element 102 at times when ink jet printing system 10 is turned on and not performing an image forming operation to raise and maintain the temperature of mass 104 within some predetermined range of a predetermined temperature value. In one embodiment of ink jet printing system 10 and air heater 22 (or air heater 100), mass 104 includes a volume of approximately 1 liter of aluminum heated to a temperature of approximately 150 degrees centigrade at a time other than during an image forming operation and the predetermined range corresponds to 5 degrees centigrade. And, for print jobs including fewer units of media 14 than the largest expected, controller 201 operates so that substantially no power is applied to heating element 102 during an image forming operation. After completion of the image forming operations included in a print job controller 201 operates to raise and maintain the temperature of mass 104 within the predetermined range of the predetermined temperature value. Operating in this manner enables ink jet printing system 10, during normal operation, to operate with a reduced likelihood of actuating circuit breaker 36. Additionally, operating in this manner enables ink jet printing system 10 to be operated on an AC power main circuit having a lower current rating, than would otherwise be used, to reduce the likelihood of actuating circuit breaker 36 during normal operation.

In one embodiment of control circuit 200 and controller 201, controller 201 monitors one or both of the temperature of air 110 and the temperature of mass 104. If, during an image forming operation, the temperature of one or both of these drops to a predetermined value indicating that the desired level of vaporization of fluid in the ink ejected onto units of the media will not likely occur, controller 201 provides a signal to power switch 202 to apply power to heating element 102 at a level reduced from the power applied to raise and maintain the temperature of mass 104 to near the predetermined temperature value during a time at which image forming operations are not performed. In one embodiment, an air temperature of 50 degrees centigrade may correspond to this predetermined value at which a reduced level of power may be applied. Additionally, controller 201 controls the operation of other assemblies included within ink jet printing system 10 (such as, media drive 12 and drive electronics 18) so that the rate of image formation on units of media is reduced to allow the desired level of vaporization of fluid from the ink with the reduced level of power applied to heating element 102.

This mode of operation may occur, for example, after image formation occurs on approximately the largest number of units of media to which mass 104 was designed to supply heat. As image formation occurs on units of media less than this largest number, heat is extracted from mass 104 while substantially no power is applied to heating element 102. As a result the temperature of air 110 and mass 104 drops until a level of the temperature of air 110 is reached at which the desired fraction of fluid included in the ink ejected onto units of media is no longer vaporized. Then, controller 201, monitoring one or both of the temperature of air 110 and the temperature of mass 104, operates ink jet printing system 10 at a reduced rate of image formation.

Shown in FIG. 3B is an embodiment of a power control circuit, power control circuit 300. As in FIG. 3A, the layout illustrated in FIG. 3B is for ease of illustration and not to indicate any particular spatial relationship between the illustrated elements. Controller 302 provides a signal to control the operation of an embodiment of a switch, power switch 304. Power switch 304 operates to selectively apply power supplied from power supply 306 to heating element 102. The characteristics of power supply 306 may be similar to those of power supply 204. Power switch 304 has a structure and function that may be similar to power switch 202. Power switch 304 may include any of a variety of suitable devices that can switch between a relatively low resistance state in which substantial power is supplied to heating element 102 and a relatively high resistance state in which substantially no power is supplied to heating element 102.

Controller 302 may include functionality in addition to functionality related to providing the signal to operate power switch 304. For example, controller 302 may include functionality to accomplish the tasks indicated for controller 20. Or, controller 302 may include functionality to accomplish fewer tasks than controller 20 or to accomplish tasks in addition to or different from those accomplished by controller 20. Similar to controller 201, controller 302 may provide a pulse width modulated signal, having a variable duty cycle, to switch a power MOSFET included in power switch 304 to vary the power supplied to heating element 102.

An embodiment of a current measurement device, current measurement device 308 provides a signal to controller 302 related to the current supplied to ink jet printing system 10. In current measurement device 308, loop 310 serves as an inductive pickup to provide a signal to current monitor 312 related to the current supplied to power supply 306, which corresponds to the current drawn by ink jet printing system 10. Current monitor 312 conditions the signal generated by loop 310 to provide the signal to controller 302 in a form usable by controller 302. Current monitor 312 may be configured to provide an analog signal or digital signal related to the current drawn by ink jet printing system 10.

In one embodiment of power control circuit 300, controller 302 provides a signal to power switch 304 to control the power supplied to heating element 102 based upon the signal received from current monitor 312, which is related to the current drawn by ink jet printing system 10. When ink jet printing system 10 is turned on and not performing an image forming operation, controller provides the signal to power switch 304 to raise and maintain the temperature of mass 104 within some predetermined range of a predetermined temperature value. During these times, a magnitude of the current drawn by ink jet printing system 10 is likely well below a level that would result in actuation of circuit breaker 36. Therefore, during these times power can be supplied to heating element 102 to raise the temperature of mass 104 at a relatively rapid rate. In one embodiment of ink jet printing system 10 and air heater 22 (or air heater 100), mass 104 includes a volume of approximately 1 liter of aluminum heated to a temperature of approximately 150 degrees centigrade at a time other than during an image forming operation.

When ink jet printing system 10 performs the image forming operations included in executing a print job, blower 24 will move air 108 across mass 104 to heat it at the appropriate time during execution of the print job. The heated air 110 will be moved across units of media 14 to vaporize fluid included in ink 30 ejected onto units of media 14. At the time when air 108 begins removing heat energy stored in mass 104, the temperature of mass 104 will be within the predetermined range of the predetermined temperature value. When sufficient heat energy has been removed from mass 104, its temperature will fall below the low end of the predetermined range. Near that time, controller 302 will begin providing the signal to power switch 304 so power is supplied to heating element 102. Controller 302 will provide this signal to power switch 304 such that the current drawn by ink jet printing system 10 is maintained at a value less than the current rating of AC power main 34 while, in particular, image forming operations are performed. This is accomplished by controller 302 generating the signal provided to power switch 304 based upon the signal provided by current monitor 312 so the current drawn by ink jet printing system 10 is maintained below this value.

In one embodiment of controller 302, the signal provided to power switch 304 includes a pulse width modulated signal with a duty cycle that is varied based upon the signal provided by current monitor 312. The duty cycle of the signal provided to power switch 304 could be adjusted by controller 302 during image forming operations until the current drawn by ink jet printing system is at a desired level below the current rating of AC power main 34. Operation by controller 302 in this manner would decrease the rate at which the temperature of mass 104 falls when heat energy is being removed from it during image formation operations, as compared to an embodiment of a power control circuit in which substantially no power was applied to mass 104 during image forming operations. This is accomplished while still achieving the benefit of reducing the likelihood of actuation of the circuit breaker or alternatively not using an AC power main circuit having a larger current rating to avoid circuit breaker actuation.

As previously mentioned, a factor influencing the amount of material included in mass 104 selected for a particular embodiment of ink jet printing system 10 is the number of units of media expected in the largest print job. Operation of controller 302 to allow power to be applied to heating element 102 during an image forming operation while maintaining the current drawn by ink jet printing system 10 a desired level below the current rating of AC power main 34 permits the use, for a given size of the largest expected print job, of a smaller amount of material for mass 104 than would be used if substantially no power were applied to heating element 102 during image forming operations.

Even with power applied to heating element 102 during the image forming operation in the manner described, the temperature of mass 104 may continue to decrease. At some temperature of mass 104, the heat transferred to air 108 will no longer be adequate to provide the desired degree of vaporization of the fluid in the ink ejected onto units of the media. When this temperature is reached, controller 302 may enter a mode of operation similar to an embodiment of controller 201 in which the image formation operation is performed at a reduced rate to accommodate the reduced amount of heat energy available for vaporizing the fluid in the ink.

During times when an image forming operation is not performed, air would not be moved across mass 104. But, mass 104 will still lose heat energy to the surrounding air when its temperature is greater than the surrounding air. This lost heat energy will be replaced as the various embodiments of the controllers operate to maintain the temperature of mass 104 within the predetermined range of the predetermined temperature. To reduce the rate at which heat is lost during times when image forming operations are not performed, embodiments of air heater 22 (or air heater 100) may make use of various embodiments of enclosures. The enclosures will reduce the rate of heat loss from mass 104. Some embodiments of these enclosures may have insulating properties to additionally reduce the rate of heat loss from mass 104. The insulating properties of the enclosure may be achieved in a variety of ways such as by including insulation in the walls of the enclosure. The insulation could include fiber glass fill or polyurethane foam. Alternatively, the enclosure could be constructed to have inner and outer walls forming a closed volume in which a partial vacuum could be sustained. In one example of the benefit of an insulated enclosure, a 1 liter volume of material insulated with R-10 (would could be achieved using about 1 inch thick layer of polyurethane foam) for storing heat energy could be maintained at near 175 degrees centigrade using approximately 5 watts of power.

To allow air to move through the enclosure and across mass 104 during image forming operations, the enclosures may include one or more types of valves. The one or more valves are configured so that during the time when image forming operations are performed, air may move through the enclosure and during the time when image forming operations are not performed, air is substantially stopped from moving through the enclosure.

Figure 4A:
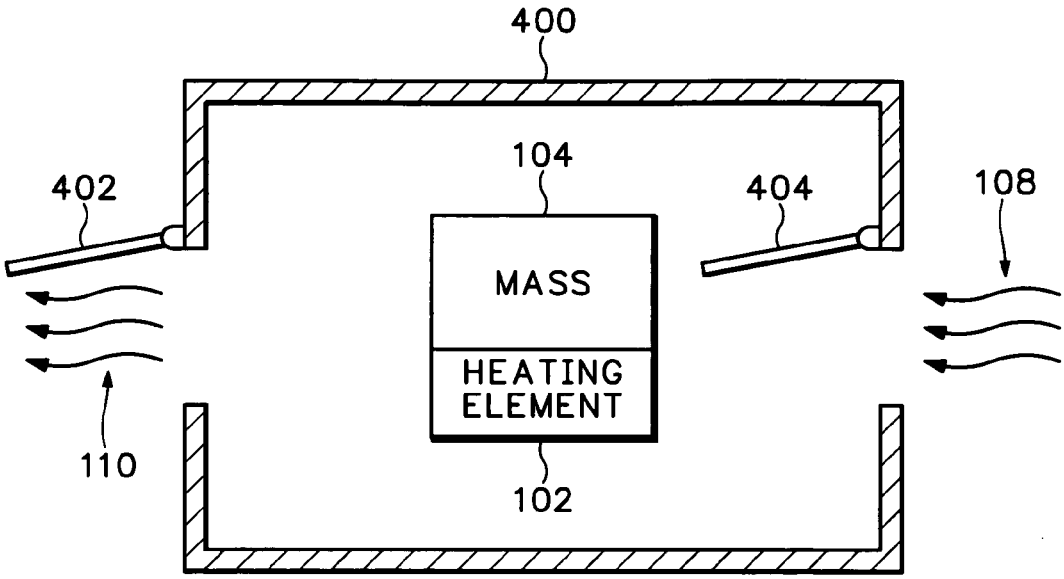

Shown in FIGS. 4A-4D are several embodiments of enclosures. Shown in FIG. 4A is an embodiment of an enclosure, enclosure 400 having embodiments of valves, flap 402 and flap 404. Flap 402 and flap 404 are attached to enclosure 400 and constructed of suitably light weight material to permit the force of moving air 108 and air 110 to move them to an open position during the times at which image forming operations are performed by ink jet printing system 10. During times at which image forming operations are not being performed by ink jet printing system 10 moving air is not available to hold flap 402 and flap 404 in the open position and both flap 402 and flap 404 return to a closed position in which air is substantially stopped from moving through enclosure 400. Enclosure 400 may be insulated as previously discussed.

Figure 4B:
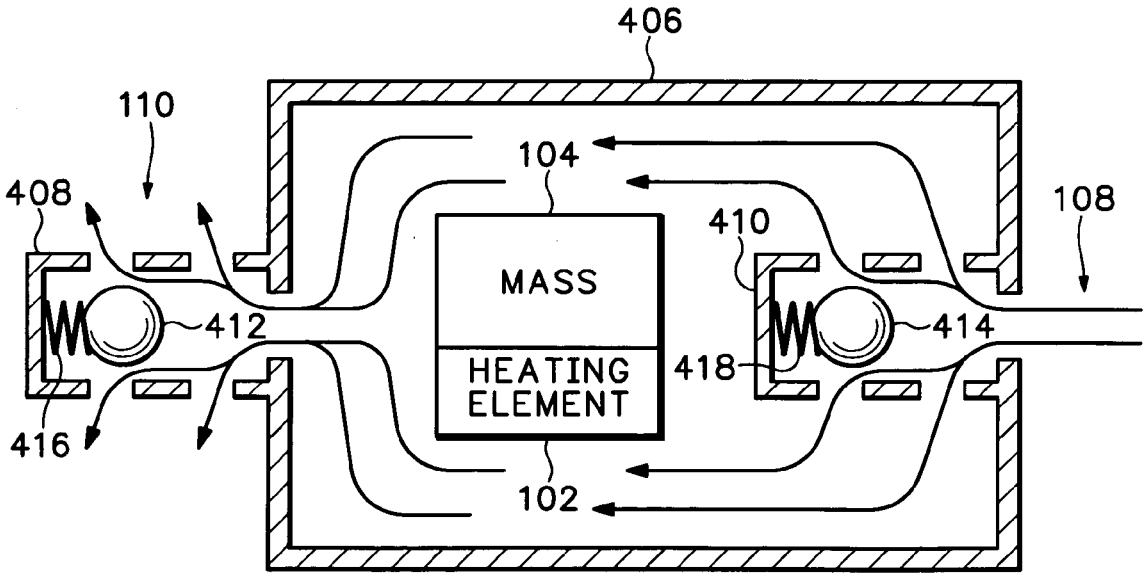

Shown in FIG. 4B is an embodiment of an enclosure, enclosure 406 having embodiments of valves, ball valve 408 and ball valve 410. Ball valve 408 and ball valve 410 are attached to enclosure 406 and include spherical shaped members, such as balls, constructed of suitably light weight material to permit the force of moving air 108 and air 110 to move ball 412 and ball 414 to an open position during the times at which image forming operations are performed by ink jet printing system 10. During times at which image forming operations are not being performed by ink jet printing system 10, moving air is not available to hold ball 412 and ball 414 in the open position and spring 416 and spring 418 push, respectively, ball 412 and ball 414 to a closed position in which air is substantially stopped from moving through enclosure 406. Enclosure 406 may be insulated as previously discussed.

Figure 4C:
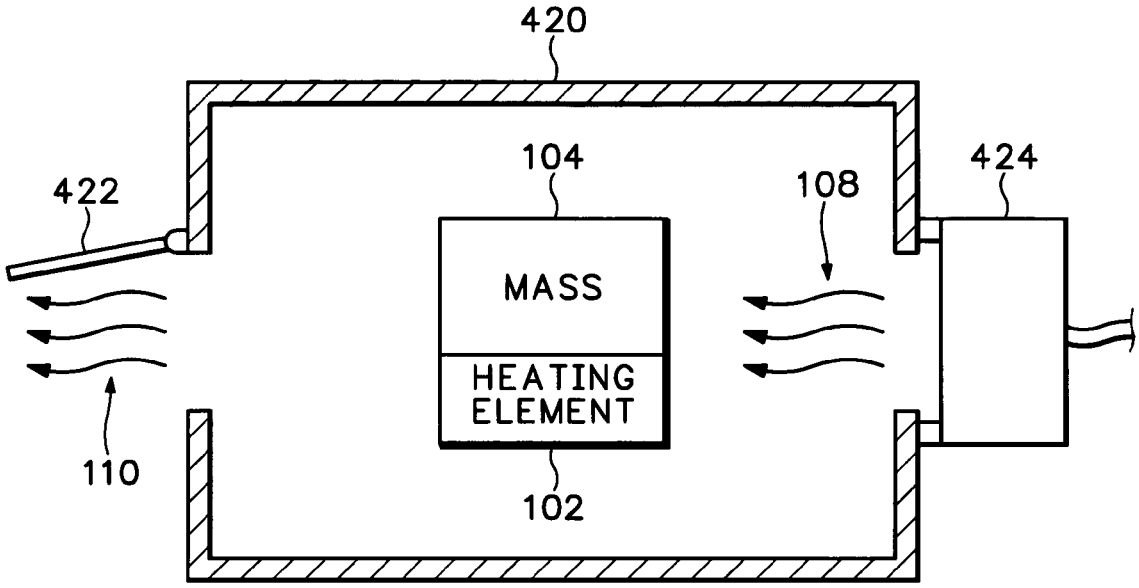

Shown in FIG. 4C is an embodiment of an enclosure, enclosure 420, using a single embodiment of a valve, flap 422. In this embodiment, an embodiment of a blower, fan 424 is attached to enclosure 420. Flap 424 moves to its open position from the force of moving air 110 and returns to its closed position, in which air is substantially stopped from moving through enclosure 420, when moving air is no longer available. Enclosure 420 may be insulated as previously discussed.

Figure 4D:
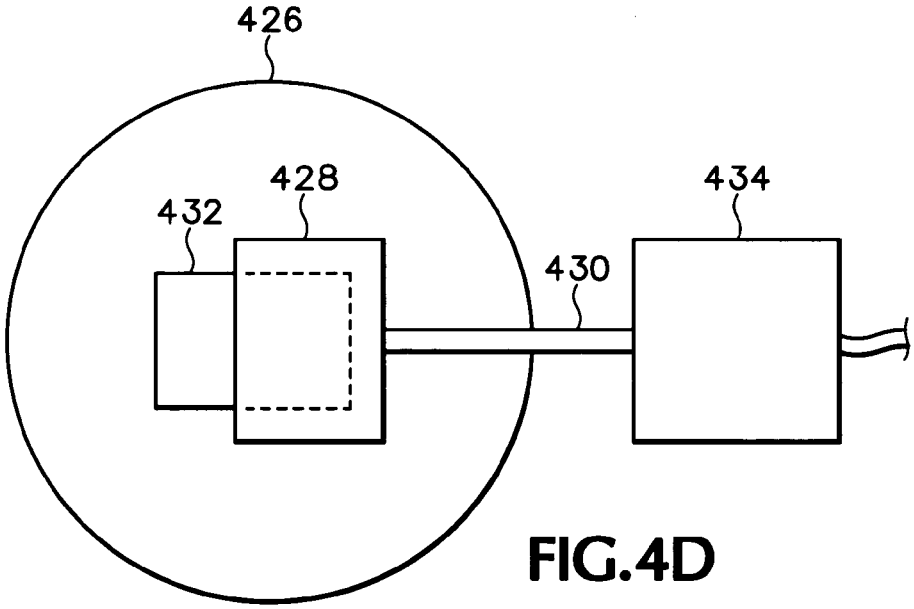

Shown in FIG. 4D is an embodiment of an enclosure, enclosure 426, including an embodiment of a valve. Cover 428 may be moved by member, such as rod 430, between an open position, in which at least a part of opening 432 is uncovered, and a closed position, in which opening 432 is blocked by cover 428. An embodiment of an actuator, such as solenoid 434, can retract rod 430 when energized, thereby moving cover 428 to an open position in which air may move through enclosure 426. To control the amount of heat energy leaving opening 432, solenoid 434 may be operated to uncover varying amounts of opening 432 according to the amount of heat desired for vaporizing fluid in the ink ejected onto units of the media. When power is removed from solenoid 434, an internal spring may be used to move cover 428 to a closed position in which air is substantially stopped from moving through enclosure 426. Enclosure 426 may be insulated as previously discussed.

Shown in FIG. 5 is an embodiment of mass 104, mass 500 that may be used in an embodiment of air heater 22 or air heater 100. It should be recognized that many different implementations of mass 104 would perform suitably. Some of the factors influencing the implementations of mass 104 include such things as space constraints inside the image forming system, heat capacity characteristics of the material selected to store heat energy, the desired quantity of heat energy to store in mass 104, and air flow characteristics inside the image forming system.

Mass 500 includes a stack of plates, of which plate 502 is exemplary, of the heat storage material separated by air gaps, of which air gap 504 is exemplary. The plates may be formed into a wide variety of shapes (circles, rectangles, ovals, etc.) suitable for the physical space they are to occupy. Mass 500 has a cylindrical shape and FIG. 5 represents an end view of mass 500. In embodiments of mass 500, the plates may include solid sheets of the heat storage material, such as aluminum, iron, and zinc. In other embodiments of mass 500, the plates may include a shell with an interior region that could be filled with a material for heat storage, such as a phase change material. Member 506 and member 508 assist in maintaining the dimensions of the air gaps between the plates and the relative horizontal positions between the plates. An embodiment of a heater, heating element 510 is centrally located in mass 500. Member 506 and member 508 assist in distributing heat energy from heating element 510 to the plates included in mass 500. The structure of mass 500 provides relatively efficient transfer of the heat energy stored in the material of mass 500 to the air moving through mass 500 because a relatively large fraction of the total volume of the heat storage material is in close proximity to the air. The cylindrical shape of mass 500 makes it particularly suitable for locating inside an enclosure having a cylindrical shape.

Shown in FIG. 6 is an embodiment of mass 104, mass 600 that may be used in an embodiment of air heater 22 or air heater 100. An embodiment of a heater, heating element 602, provides heat energy to material 604. Movement of air between protrusions, such as fins, of which fin 604 is exemplary, assists in the transfer of the heat energy stored in material 604 to the air.

Shown in FIG. 7 is measurement data related to an embodiment of a mass. The measurement data was collected using an embodiment of a mass having a configuration similar to that of mass 500 shown in FIG. 5. The embodiment of the mass used for the measurement data of FIG. 7 included approximately 1.7 liters of aluminum such that the volume of the embodiment of the mass includes approximately half air and half aluminum. The horizontal axis 700 indicates time measured in seconds. The left vertical axis 702 indicates temperature in degrees centigrade. The right vertical axis 704 indicates power in watts. Curve 706 represents the measured temperature of air, over time, not heated by the embodiment of the mass. This air would correspond to air 26 and air 108 in the other figures. Curve 708 represents the measured temperature of air, over time, heated by the embodiment of the mass. This air would correspond to air 28 and air 110 in the other figures. Curve 710 represents the power (indicated with respect to right vertical axis 704) transferred over time to the heated air. As can be seen from curve 710, a substantial amount of power is transferred from the embodiment of the mass to the air and thereby made available for vaporizing fluid included in the ink ejected onto units of the media.

As previously mentioned, embodiments of ink jet printing system 10 may store heat energy in mass 104 while ink jet printing system 10 is not performing an image forming operation to maintain the current drawn by ink jet printing system 10 below the current rating of AC power main 34. Some embodiments of image forming systems are configured to comply with various governmental energy usage regulations, such as the Energy Star regulations. Energy usage regulations generally define a low power mode of operation in which the power drawn by the image forming system stays below a specified value. Additionally, the time period permitted from the end of image forming operations, or after start up, to the entry of the lower power mode may also be defined. For example, for some classes of systems, the Energy Star regulations set the power limit at 45 watts and the time period after which the lower power mode is to be entered at 15 minutes.

One embodiment of ink jet printing system 10 could be configured so that the controller operates the air heater to raise the temperature of the mass used to store heat energy (after it has been reduced by heating air or upon start up) to the predetermined temperature value during the 15 minute period after image forming operations have ended or after power is applied to ink jet printing system 10. Then, with adequate insulation in the enclosure surrounding the air heater, the mass could be maintained within a predetermined temperature range of the predetermined temperature with the power drawn by ink jet printing system 10 below the 45 watt limit.

One embodiment of ink jet printing system 10 could be configured so that the controller operates the air heater to raise the temperature of the mass to near the predetermined temperature (after it has been reduced by heating air or upon start up) while ink jet printing system 10 is in the low power mode. Raising the temperature of the mass in this manner would use a relatively long period of time because of the power limit below which ink jet printing system 10 would operate. However, if the power applied to the mass exceeded the power lost by the mass, which is achievable with an insulated enclosure, raising the temperature of the mass to near the predetermined fashion could be achieved. One embodiment of the air heater tested, using a mass in an insulated enclosure, was able to maintain a temperature of the mass near 150 degrees centigrade using less than 10 watts of power.

One embodiment of ink jet printing system 10 could be configured so that the controller operates the air heater to raise the temperature of the mass to near the predetermined temperature (after it has been reduced by heating air or upon start up) by having ink jet printing system 10 exit the low power mode and enter a servicing mode permitted by the energy usage regulations. In one embodiment, the controller may be configured to have ink jet printing system exit the low power mode and enter a servicing mode to heat the mass at a predetermined time, such relatively shortly before the start of a work day. In another embodiment, the controller could be configured to select the times to exit the low power mode and enter the servicing mode to heat the mass based upon usage patterns of ink jet printing system 10 recorded by the controller. Based upon the pattern of usage, the controller would have the mass heated to near the predetermined temperature so it will likely be available for use when desired.

While the disclosed embodiments have been particularly shown and described, those skilled in the art will understand that many variations may be made to these without departing from the spirit and scope defined in the following claims. The detailed description should be understood to include all novel and non-obvious combinations of the elements that have been described, and claims may be presented in this or a later application to any novel and non-obvious combination of these elements. Combinations of the above exemplary embodiments, and other embodiments not specifically described herein will be apparent to those of skill in the art upon reviewing the above detailed description. The foregoing embodiments are illustrative, and any single feature or element may not be included in the possible combinations that may be claimed in this or a later application. Therefore, the scope of the claimed subject matter should be determined with reference to the following claims, along with the full range of equivalents to which such claims are entitled.

What is claimed is:

1. An air heating apparatus for use in an image forming system configured to deposit colorant on media during an image forming operation, comprising:

a mass to store heat energy;

a heater to provide the heat energy to the mass;

a power source to supply power to the heater;

an air movement device to push air toward the mass wherein heat is transferred from the mass to the air, and to move heated air from the mass toward the media; and circuitry to control operation of the heater during the image forming operation to maintain a magnitude of current supplied by the power source to the heater below a current rating of the power source, wherein the circuitry is configured to control power applied to the heater according, at least in part, to a temperature of at least one of the mass and the heated air, and wherein the heated air provides energy to vaporize at least part of fluid included in the colorant deposited on the media during the image forming operation.

2. The air heating apparatus as recited in claim 1, wherein: the mass includes one or more of zinc, iron, and aluminum.

3. The air beating apparatus as recited in claim 1, wherein: the mass includes a phase change material.

4. The air heating apparatus as recited in claim 3, wherein: the phase change material includes a low temperature alloy.

5. The air beating apparatus as recited in claim 4, wherein: the low temperature alloy includes Metspec 281.

6. The air heating apparatus as recited in claim 3, wherein: the phase change material includes wax.

7. The air heating apparatus as recited in claim 6, wherein: the wax includes paraffin.

8. The air heating apparatus as recited in claim 1, wherein: the circuitry includes a current measurement device to measure the magnitude of the current supplied by the power source; and the circuitry includes a processing device configured to control the application of power to the heater according to the magnitude of the current measured by the current measurement device.

9. The air heating apparatus as recited in claim 1, wherein:

the circuitry includes a processing device configured to control application of power to the heater to apply substantially none of the power to the heater with the image forming system performing the image forming operation.

10. The air heating apparatus as recited in claim 9, wherein:

the image forming system includes a configuration to selectively operate in a low power mode; and the processing device includes a configuration to control application of the power to the heater to maintain a temperature of the mass within a predetermined range of a predetermined temperature with the image forming system operating in the low power mode.

11. The air heating apparatus as recited in claim 1, wherein:

the image forming system includes an ink jet printing system.

12. The air heating apparatus as recited in claim 1, wherein:

the mass includes a member having a plurality of fins.

13. The air heating apparatus as recited in claim 1, further comprising:

an enclosure for containing the mass.

14. The air heating apparatus as recited in claim 13, wherein:

the enclosure includes at least one valve.

15. The air heating apparatus as recited in claim 14, wherein:

during vaporization of fluid in colorant deposited onto units of media, the at least one valve exists in an open condition.

16. The air heating apparatus as recited in claim 14, wherein:

at times other than during vaporization of fluid in colorant deposited onto units of media, the at least one valve exists in a closed condition.

17. The air heating apparatus as recited in claim 14, wherein:

the at least one valve includes a first valve and a second valve.

18. The air heating apparatus as recited in claim 17, wherein:

during vaporization of fluid in colorant deposited onto units of media, the flint valve and the second valve exist in an open condition.

19. The air heating apparatus as recited in claim 17, wherein:

at times other than during vaporization of fluid in colorant deposited onto units of media, the first valve and the second valve exist in a closed condition.

20. The air heating apparatus as recited in claim 14, wherein:

the at least one valve includes a flap movable by the air moved by the air movement mechanism.

21. The air heating apparatus as recited in claim 14, wherein:

the at least one valve includes a spherical member movable by the air moved by the air movement device.

22. The air heating apparatus as recited in claim 1, wherein:

the mass includes a plurality of plates separated by a plurality of air gaps.

23. The air heating apparatus as recited in claim 1, wherein:

the heater is capable of supplying a level of output power to result in the magnitude of the current that would exceed the current rating of the power source absent over current protection; and the circuitry includes a configuration to control the output power supplied by the heater during the image forming operation to maintain the magnitude of the current below the current rating.

24. The air heating apparatus as recited in claim 1, wherein:

absent over current protection, the magnitude of the current supplied by the power source would exceed the current rating of the power source during the image forming operation.

25. An air heating apparatus for use in an ink jet printing system configured to deposit colorant on media during an image forming operation, comprising;

a mass, including a volume of a material, to store heat energy;

a heater to provide the heat energy to the mass;

a power source to supply power to the heater;

an air movement mechanism to push air toward the mass wherein heat is transferred from the mass to the air, and to move heated air from the mass toward the media; and a circuit including a processing device configured to control the operation of the heater during the image forming operation to maintain a magnitude of current supplied by the power source to the heater below a current rating of the power source, wherein the processing device is configured to control power applied to the heater according, at least in part, to a temperature related to a temperature of the material, and wherein the heated air provides energy to vaporize at least part of fluid included in the colorant deposited on the media during the image forming operation.

26. The air heating apparatus as recited in claim 25, wherein:

the mass includes the material formed into a block having a plurality of protrusions; and the heater contacts the block.

27. The air heating apparatus as recited in claim 25, wherein:

the mass includes a configuration with the material formed into a plurality of plates separated by a plurality of members and a plurality of air gaps between the plurality of plates.

28. The air heating apparatus as recited in claim 25, wherein:

the material includes or more of zinc, aluminum, and iron.

29. The air heating apparatus as recited in claim 25, wherein:

the material includes a phase change material.

30. The air heating apparatus as recited in claim 29, wherein:

the phase change material includes paraffin.

31. The air heating apparatus as recited in claim 29, wherein:

the phase change material includes Metspec 281.

32. The air heating apparatus as recited in claim 25, wherein:

the volume includes at least 1 liter of the material.

33. The air heating apparatus as recited in claim 25, further comprising:

an enclosure surrounding the mass and having at least one valve.

34. The air heating apparatus as recited in claim 33, wherein:

the enclosure includes insulation.

35. The air heating apparatus as recited in claim 33, wherein:

the air movement mechanism includes a blower attached to the enclosure opposite the at least one valve.

36. The air heating apparatus as recited in claim 25, wherein:

the processing device is configured to control application of the power to the heater to substantially zero during the image forming operation with the temperature exceeding a predetermined value and configured to control application of the power during the image forming operation with the temperature equal to or less than the predetermined value to maintain the current supplied by the power source below the current rating of the power source.

37. The air heating apparatus as recited in claim 36, wherein:

the temperature corresponds to a temperature of the material.

38. The air heating apparatus as recited in claim 36, wherein:

the temperature corresponds to a temperature of the air.

39. The air heating apparatus as recited in claim 25, wherein:

the temperature corresponds to a temperature of the material.

40. The air heating apparatus as recited in claim 39, wherein:

the processing device includes a configuration to control the output power supplied by the heater during the image forming operation to maintain the magnitude of the current below the current rating of the power source.

41. The air heating apparatus as recited in claim 40, wherein:

the circuit includes a current measurement device to measure the magnitude of the current; and the processing device includes a configuration to control the application of the power to the heater according to the magnitude of the current measured by the current measurement device and the temperature.

42. The air heating apparatus as recited in claim 25, wherein:

the temperature corresponds to the temperature of the material; and the processing device is configured to control application of the power to the heater to substantially zero during the image forming operation, configured to control application of the power to the heater at times other than during the image forming operation to maintain the temperature of the material within a predetermined range of a predetermined temperature, and configured to operate the ink jet printing system at a reduced rate with the temperature of the material equal to or less than a predetermined value during the image forming operation.

43. The air heating apparatus as recited in claim 42, wherein:

the predetermined temperature equals at least 100 degrees centigrade; and the predetermined value equals or exceeds 40 degrees centigrade and falls below the predetermined temperature.

44. The air heating apparatus as recited in claim 25, wherein:

absent over current protection, the heater is capable of supplying a level of output power to result in the magnitude of the current supplied by the power source that would exceed the current rating of the power source during the image forming operation.

45. The air heating apparatus as recited in claim 25, wherein:

the volume includes at least 0.1 liter of the material.

46. An air heating apparatus for use in an image forming system configured to deposit colorant on media during an image forming operation, comprising:

a mass configured to store heat energy;

a heater to provide the heat energy to the mass;

a power source to supply power to the heater;

an air movement device to push air toward the mass wherein heat is transferred from the mass to the air, and to move heated air from the mass toward the media; and a circuit configured to control application of power to the heater during the image forming operation to maintain a magnitude of current supplied by the power source to the heater below the current rating of the power source, wherein the circuit is configured to control power applied to the heater according to a temperature related to a temperature of the heated air, and wherein the heated air provides energy to vaporize at least part of fluid included in the colorant deposited on the media during the image forming operation.

47. The air heating apparatus as recited in claim 46, wherein:

the mass includes a configuration to supply at least 240 kilojoules of the heat energy.

48. The air heating apparatus as recited in claim 46, wherein:

the material includes or more of zinc, aluminum, and iron.

49. The air heating apparatus as recited in claim 46, wherein:

the material includes a phase change material.

50. The air heating apparatus as recited in claim 46, wherein;

the circuit includes a processing device configured to control application of the power to the heater to substantially zero during the image forming operation, configured to control application of the power to the heater at times other than during the image forming operation to maintain a temperature of the material within a predetermined range of a predetermined temperature, and configured to operate the image forming system at a reduced rate with the temperature of the material equal to or less than a predetermined value during the image forming operation.

51. The air heating apparatus as recited in claim 46, wherein:

the circuit includes a current measurement device to measure the magnitude of the current; and the circuit includes a processing device configured to control the application of the power to the heater according to the magnitude of the current measured by the current measurement device and a temperature of the material.

52. The air heating apparatus as recited in claim 46, wherein:

absent over current protection, the heater including a capability to supply a level of output power to result in the magnitude of the current supplied by the power source that would exceed the current rating of the power source during the image forming operation.

53. The air heating apparatus as recited in claim 46, wherein:

the mass includes a configuration to supply at least 24 kilojoules of the heat energy.

* * * * *

UNITED STATES PATENT AND TRADEMARK OFFICE

CERTIFICATE OF CORRECTION

PATENT NO. : 7,449,662 B2
APPLICATION NO. : 10/832089
DATED : November 11, 2008
INVENTOR(S) : Steven B. Elgee et al.

It is certified that error appears in the above-identified patent and that said Letters Patent is hereby corrected as shown below:

In column 12, line 52, in Claim 3, delete "beating" and insert -- heating --, therefor.

In column 12, line 58, in Claim 5, delete "beating" and insert -- heating --, therefor.

In column 13, line 49, in Claim 18, delete "flint" and insert -- first --, therefor.

In column 14, line 17, in Claim 25, delete "comprising;" and insert -- comprising: --, therefor.

In column 14, line 51, in Claim 28, after "includes" insert -- one --.

In column 16, line 30, in Claim 48, after "includes" insert -- one --.

In column 16, line 35, in Claim 50, delete "wherein;" and insert -- wherein: --, therefor.

Signed and Sealed this

Sixth Day of October, 2009

David J. Kappos

David J. Kappos
*Director of the United States Patent and Trademark Office*